US007106163B2

(12) United States Patent
Jin et al.

(10) Patent No.: US 7,106,163 B2
(45) Date of Patent: Sep. 12, 2006

(54) CORE

(75) Inventors: Dongzhi Jin, Chiba (JP); Fumihiko Abe, Chiba (JP); Hajime Mochizuki, Tokorozawa (JP); Hideharu Yonehara, Hiratsuka (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 287 days.

(21) Appl. No.: 10/180,268

(22) Filed: Jun. 26, 2002

(65) Prior Publication Data

US 2003/0020588 A1 Jan. 30, 2003

Related U.S. Application Data

(63) Continuation-in-part of application No. 09/424,105, filed as application No. PCT/JP99/01567 on Mar. 26, 1999, now abandoned.

(30) Foreign Application Priority Data

Mar. 27, 1998 (JP) ..... 10-81651

(51) Int. Cl.
*H01F 27/24* (2006.01)

(52) U.S. Cl. ..... 336/233

(58) Field of Classification Search ..... 336/83, 336/115–127, 130–135, 233, 212, 234; 310/44; 252/62.54

See application file for complete search history.

(56) References Cited

U.S. PATENT DOCUMENTS

| | | | | |
|---|---|---|---|---|
| 4,543,208 | A | | 9/1985 | Horie et al. |
| 4,697,927 | A | | 10/1987 | Ono |
| 4,719,377 | A | * | 1/1988 | Horie et al. ..... 310/44 |
| 5,160,447 | A | * | 11/1992 | Ishikawa et al. ..... 252/62.54 |
| 5,625,454 | A | | 4/1997 | Huang |
| 5,844,670 | A | | 12/1998 | Morita |
| 5,896,078 | A | | 4/1999 | Hayakawa et al. |

FOREIGN PATENT DOCUMENTS

| | | | |
|---|---|---|---|
| JP | 56-104412 | * | 8/1981 |
| JP | 59-26214 U | | 2/1984 |
| JP | 59-210623 A | | 11/1984 |
| JP | 61-084006 A | | 4/1986 |
| JP | 01-223704 | * | 9/1989 |
| JP | 01-315118 A | | 12/1989 |
| JP | 03-216802 | * | 9/1991 |
| JP | 04-037104 A | | 2/1992 |
| JP | 05-090052 A | | 4/1993 |
| JP | 05-258963 A | | 10/1993 |
| JP | 05-258964 | * | 10/1993 |
| JP | 06-267750 | * | 9/1994 |
| JP | 6-267750 | | 9/1994 |
| JP | 7-307237 A | | 11/1995 |

OTHER PUBLICATIONS

International Search Report From PCT/EP02/07378 mailed on Nov. 15, 2002.

V. Greco, et al., "Interferometric testing of weak aspheric surfaces versus design specifications", Optik, 87, No. 4 (1991), pp. 159-162.

* cited by examiner

*Primary Examiner*—Tuyen T Nguyen
(74) *Attorney, Agent, or Firm*—Frishauf, Holtz, Goodman & Chick, P.C.

(57) ABSTRACT

An isolation transformer core having a coil and a core member made by injection molding a mixture containing 10 to 50±3 volume % of a soft magnetic material and the remainder being an insulating material having an electrical insulating property.

20 Claims, 6 Drawing Sheets

CORE

CROSS-REFERENCES TO RELATED APPLICATION

This application is a Continuation-In-part application of Ser. No. 09/424,105 filed Nov. 18, 1999now abandoned, which is a 371 of PCT/JP99/01567 filed Mar. 26, 1999.

BACKGROUND OF THE INVENTION

1. Technical Field

The present invention relates to a core, and more specifically, to an isolation transformer core applicable to an automobile component and an automotive component including a core comprising an injection molded core member.

2. Related Art

An isolation transformer includes cores having coils thereof arranged to face each other to transmit electric power or an electric signal between each other through electromagnetic coupling of the opposite coils in a contactless manner.

For example, a rotary transformer of this type includes an isolation transformer in which a primary core is fixed and a secondary core is rotatably arranged, and a rotary transformer for a rotary head of a video tape recorder is generally known.

In the rotary transformer, in order to make a coupling coefficient of coils in cores large, cores having a high relative permeability are used and a gap between the cores is restricted to several μm. In the rotary transformer, when the coupling coefficient of the coils is very large, self-inductance and mutual inductance of the two opposite coils cancel each other, so that input-output impedance of the transformer is small. Therefore, in the rotary transformer, impedance matching between the coils and a load can be easily attained.

As cores of the rotary transformer, sintered ferrite cores are generally used. The sintered ferrite core is favorable as a core of a high frequency transformer in that it has a very high relative permeability and produces only a very small eddy-current loss.

In the rotary transformer in which primary and secondary cores are brought into a relative rotation, the size of a gap between the cores has a direct influence on manufacturing cost. In a rotary transformer having a large coupling coefficient of coils, in order to provide a gap between cores of several μm, high manufacturing precision and high assembling precision of components are required, which causes high manufacturing cost. In the case of an automobile, strict restriction is imposed on manufacturing cost and very strong vibration is produced during driving. Therefore, the rotary transformer for an automobile needs to have a gap of 0.5 mm or larger between the opposite cores.

The sintered ferrite core has favorable properties as mentioned above, but has a drawback peculiar to sintered oxide: fragility.

Therefore, when sintered ferrite cores are to be used as cores of a connector for an automobile, for example, cores of a connector for an air bag, various consideration is needed, for example, about how to prevent vibration, how to fix the cores and the like. Also in view of manufacturing cost, the sintered ferrite core is difficult to apply to an automobile component.

An automobile is equipped with, as an automobile component, a rotation sensor for detecting a rotary angle. A rotation sensor of electromagnetic induction type is provided with a first rotor, a stationary core fixed to a stationary member, and a second rotor disposed between the first rotor and the stationary core, for instance. The first rotor and the stationary core are made of a magnetic material having a high permeability. A coil is accommodated in the stationary core. The first rotor and the stationary core form a magnetic circuit. When an excitation current flows through the coil, alternating magnetic field is produced. An automotive rotation sensor is required to be small in size and high in accuracy, and hence a core member (such as the first rotor and a core body of the stationary core) is required to have high flowability during molding.

DISCLOSURE OF THE INVENTION

An object of the present invention to provide an isolation transformer core which is less fragile and easy to manufacture.

Another object of the present invention is to provide an automotive component having a core that comprises an injection molded core member having high flowability during molding.

In order to apply a rotary transformer to an automobile component, in particular to a connector for an air bag, the inventors have earnestly worked on a study.

First, an isolation transformer used as a connector for an air bag needs to be able to make large current flow to an air bag inflating unit under a low voltage of 12V (battery for an automobile) to transmit large power at a high speed. In this connection, impedance matching between a load and coils is very important.

In order to permit rapid transmission of large amounts of power to an air bag inflating unit, the following conditions need to be satisfied:

(1) The allowable maximum delay time is about 1 msec. Therefore, the frequency of a transmission signal needs to be higher than several kHz.

(2) The diameter of a steering-wheel shaft of an automobile is about 30 mm. The inside diameter of a center through-hole of a core needs to be larger than the diameter of the steering-wheel shaft. Therefore, the diameter of a coil needs to be about 45 mm or larger. The inductance of a coil is proportional to a square of the diameter thereof. Therefore, in order to make the impedance of a coil small when a high-frequency signal is transmitted, it is the most effective to make the effective relative permeability in a magnetic circuit appropriately small. Normally, the inductance of two coils needs to be as small as several μH (the impedance of a load on the secondary side, that is, the inflating unit is about 2Ω). In order to meet this condition, it is important to make the effective relative permeability in the magnetic circuit appropriately small.

The inventors have researched on the effective relative permeability between coils of an isolation transformer (for example, using generally used sintered ferrite cores having a relative permeability of about 3000 to 10000).

First, in the case where the ratio of the length of the entire magnetic circuit between the coils to the size of the gap between the cores is approximately the same as the relative permeability of the core members (for example, the length of the magnetic circuit is 100 mm and the gap between the cores is several tens μm), the effective relative permeability in the magnetic circuit varies to a large extent, depending on the size of the gap. This means that the coupling state of the coils varies even when the gap between the cores varies only a little due to vibration of the automobile.

Second, in the case where the ratio of the length of the entire magnetic circuit between the coils to the size of the gap between the cores is much smaller than the relative permeability of the core members (for example, the length of the magnetic circuit is 100 mm and the gap between the cores is several mm), the effective relative permeability in the magnetic circuit almost exclusively depends on the size of the gap between the cores. Therefore, however high the relative permeability of the core members may be, the effective relative permeability in the magnetic circuit is almost determined by the size of the gap between the cores.

Thus, it has been found out that the effective relative permeability in the magnetic circuit formed between the coils is determined by the relative permeability of the core members and the size of the gap between the cores, and that the size of the gap between the cores is a factor having a particularly large influence on the effective relative permeability in the magnetic circuit.

From the above, the inventors have obtained a knowledge that an isolation transformer using cores of magnetic material of a low relative permeability (for example, mixed magnetic material) and having a larger gap between the cores shows an effective relative permeability in the magnetic circuit between the coils slightly lower than that of an isolation transformer using conventional sintered ferrite cores, but that it is suited to rapidly transmit large amounts of power and has advantages of improved vibration resistance and lowered manufacturing cost (suited for mass production).

Based on the above knowledge, the present invention has been made to obtain an isolation transformer core suitable for a connector for an air bag installed in an automobile and permits rapid transmission of large amounts of power.

The isolation transformer core according to one aspect of the present invention comprises a coil and a core member, and is characterized in that the core member comprises a mixed soft magnetic material which comprises an insulating material having an electrical insulating property and a soft magnetic material.

In the isolation transformer core of the present invention, it is favorable that the soft magnetic material content is in the range of 10 to 70 volume %.

In the isolation transformer core of the present invention, it is favorable that the soft magnetic material is soft magnetic ferrite or Sendust.

In the isolation transformer core of the present invention, it is favorable that the insulating material is any one of thermoplastic resin, thermoplastic rubber, silicone rubber, thermosetting resin and adhesive.

According to another aspect of the present invention, there is provided an automotive component that comprises a core comprising an injection-molded core member. The core member is formed by injection-molding a mixed soft magnetic material which includes 10 to 50 volume % insulating material having an electrical insulating property and the remainder soft magnetic material.

An automotive component such as a rotation sensor is requested to satisfy the following requirements.

(1) An air gap formed between two rotors of the rotation sensor should be large enough so as not to hinder the rotors from rotating.

(2) To ensure the accuracy of measurement by the rotation sensor, influence of a variation in air gap caused by rotation of the rotors on the effective relative permeability of a magnetic circuit should be reduced (Ordinarily, the air gap is set to about ten times as large as an actual variation in air gap).

(3) To satisfy the demand of a space-saving automotive steering to which the rotation sensor is mounted, a core of the rotation sensor is required to be small in size and accurate in dimension. Accordingly, the core is requested to be comprised of a core member having high flowability during injection-molding.

To satisfy the above requirements, the core of an automotive rotation sensor is satisfactory if its core member has the relative permeability equal to or larger than about 1.6. In view of a sensing characteristic, the relative permeability is preferably to be equal to or larger than about 5, more preferably equal to or larger than about 8.5. To attain such a preferred relative permeability and at the same time increase the flowability during injection-molding, the core member includes 10 to 50±3% soft magnetic material, preferably, 30 to 50±3%, more preferably 50±3% soft magnetic material.

The effective relative permeability of a magnetic circuit in the rotation sensor is mainly determined by the magnitude of the air gap. Accordingly, even if the mixing ratio of soft magnetic material is lowered to about 35% so as to improve the formability of the core, resultant reduction in the relative permeability of the core can produce a slight influence on the effective relative permeability of the magnetic circuit.

DETAILED DESCRIPTION

Figure 1:
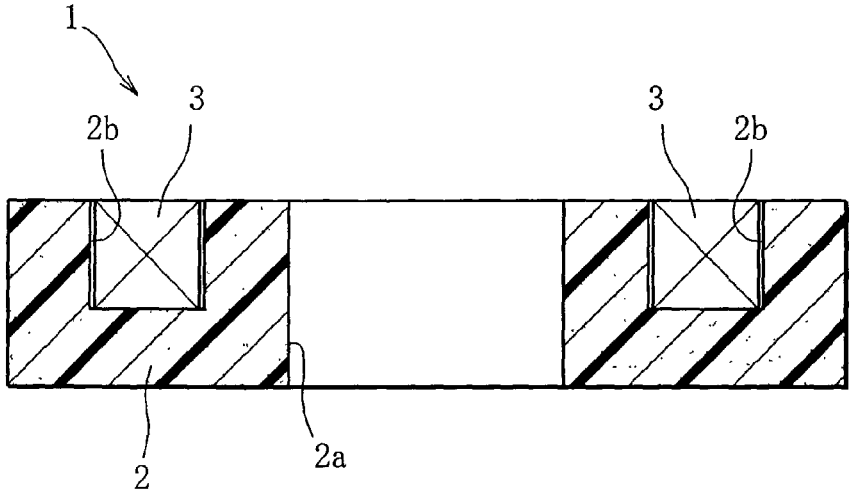
FIG. 1 is a cross-sectional view of an isolation transformer core according to a first embodiment of the present invention.

As shown in FIG. 1, an isolation transformer core 1 according to a first embodiment of the present invention comprises a core member 2 and a coil 3. The core member 2 is made of a mixed soft magnetic material which is a mixture of an insulating material having an electrical insulating property and a soft magnetic material, and formed into a desired core shape.

Here, if the soft magnetic material content of the mixed soft magnetic material is lower than 10 volume %, the relative permeability of the core member formed thereof is lower than 2, so that it is difficult to attain the required transmission efficiency of an isolation transformer. On the other hand, if the soft magnetic material content is higher than 70 volume %, the relative permeability of the core member formed thereof is high (it may be higher than 20, depending on the kind and grain diameter of soft magnetic material). This is favorable to raise the transmission efficiency of an isolation transformer, but the core itself is fragile. Further, if synthetic resin (described later) is used as the insulating material, flowability lowers, which makes injection molding difficult. Therefore, the soft magnetic material content of the mixed soft magnetic material is chosen in the range of 10 to 70 volume %.

In view of vibration resistance and formability, synthetic resin is favorable to be used as the insulating material. As the synthetic resin, for example, a thermoplastic resin such as nylon 6, nylon 66, nylon 11, nylon 12, polypropylene, polyphenylene sulfide or polyolefine, a thermoplastic rubber such as urethane, polyester or olefine, a thermosetting resin such as silicone rubber, epoxy resin, phenolic resin or diallyl phthalete, or two-liquid mixing adhesive can be used. When a synthetic resin as mentioned above is used as the insulating material, injection molding or the like can be applied to the mixed soft magnetic material. Therefore, a core member of a desired shape can be formed easily. Further, since the synthetic resin has flexibility, shock resistance of the formed core member is improved, and therefore the vibration resistance of the isolation transformer core itself is improved.

In view of heat resistance and the like, ceramic is favorable to be used as the insulating material. Zirconia ceramic or silicon nitride ceramic which have high strength and high toughness can be used. As the zirconia ceramic, partial stabilized zirconia ceramic is in particular favorable. When the ceramic is used as the insulating material, powdered ceramic and powdered soft magnetic material are mixed to produce a mixed soft magnetic material. Then the mixed soft magnetic material is formed into a desired shape and subjected to press sintering or HIP (hot isostatic pressing) to produce a desired isolation transformer core. The isolation transformer core produced this way has better heat resistance and wear resistance due to the ceramic.

Among the above mentioned insulating materials, nylon is favorable in that it is inexpensive, fuses well with the soft magnetic material, and exhibits good flowability in injection molding.

As the soft magnetic material, for example, soft magnetic ferrite, Sendust, permalloy, high-permeability amorphous material or the like can be used.

As the soft magnetic ferrite, for example, spinel ferrite represented by a general expression $MO.Fe_2O_3$ (where M is at least one element chosen from Zn, Mn, Ni, Cu and Fe), or compound ferrite made of several kinds of the above spinel ferrites can be used. Mn—Zn ferrite, Ni—Zn ferrite and Ni—Zn—Cu ferrite are in particular favorable. The favorable compounding ratio of Mn—Zn ferrite is $MnFe_2O_4$:$ZnFe_2O_4$=1:1 (mole % ratio), and the favorable compounding ratio of Ni—Zn ferrite is $NiO:ZnO:Fe_2O_3$=15:35:50 (mole % ratio). The soft magnetic ferrite is used in a powdered state, and powdered soft magnetic ferrite whose maximum grain diameter is 100 μm or smaller is favorable. Powdered soft magnetic ferrite having an average grain diameter of 3.8 μm is more favorable.

As the Sendust, Fe—Si—Al alloy containing about 6 to 11 weight % of Si and about 4 to 6 weight % of Al can be used. 9.62 weight % Si-5.38 weight % Al-bal.Fe alloy is in particular favorable. The Sendust is used in a powdered state. Powdered Sendust having an average grain diameter of 10 μm or smaller is favorable.

As the permalloy, Fe—Ni alloy containing 35 to 80 weight % of Ni can be used. 78 weight % Ni permalloy, 48 weight % Ni permalloy, and supermalloy (79 weight % Ni-5 weight % Mo-0.3 weight % Mn-bal.Fe) are favorable. The permalloy is used in a powdered state. Powdered permalloy whose maximum grain diameter is 100 μm or smaller is favorable.

As the high-permeability amorphous material, Fe amorphous material or Co amorphous material can be used. The high-permeability amorphous material is also used in a powdered state having an average grain diameter of 1 to 500 μm.

In the present invention, an insulating material and a soft magnetic material are mixed and fused to produce a mixed soft magnetic material 2. If synthetic resin is used as the insulating material, the mixed soft magnetic material 2 exhibits good flowability when it is heated to fuse. Therefore, it can be easily formed by injection molding into a desired shape, for example, into a disc-shaped core member 2 having a though-hole 2*a* at the center and a coil groove 2*b* for receiving a coil 3 in the disc face, as shown in FIG. 1.

A coil 3 having a predetermined number of turns is placed in the coil groove 2*b* of the formed core member 2 to form an isolation transformer core 1. Alternatively, an isolation transformer core may be molded from the mixed soft magnetic material together with the coil 3 having a predetermined number of turns.

The isolation transformer cores each having a coil placed therein are arranged to face each other to form an isolation transformer. The isolation transformer is used, for example, as a connector for an air bag.

Next, how the isolation transformer cores of the present invention are used for a connector for an air bag will be explained.

First, in a steering section of an automobile, a primary transformer core is set on a fixed portion (a column side) and a secondary transformer core is set on a rotary portion (steering portion). Here, in view of vibration produced on an automobile and the like, the primary and secondary transformer cores are arranged to face each other with a gap of 1 mm±0.5 mm therebetween. Here, a primary-side coil is connected with a control unit for controlling an air bag inflating unit, and a secondary-side coil is connected with the air bag inflating unit.

The core members of the present invention have a relatively low relative permeability (for example, the relative permeability of a core member made of a mixed soft magnetic material comprising soft magnetic ferrite ($MnFe_2O_4$—$ZnFe_2O_4$) and nylon 6 is about 3 to 12). Therefore, the inductance of the coils is small, and therefore impedance matching between the coils and a load, that is, the inflating unit can be easily attained. Thus, the isolation transformer using the isolation transformer cores comprising the core members described above is suited to rapidly transmit large amounts of power.

EXAMPLES

As soft magnetic materials, Mn—Zn soft magnetic ferrite ($MnFe_2O_4$—$ZnFe_2O_4$) powder and Ni—Zn soft magnetic ferrite ($NiO$—$ZnO$—$Fe_2O_3$) powder whose maximum grain diameter was 50 μm were prepared. As insulating materials having an insulating property, nylon pellets (nylon 6) and polypropylene pellets as used in ordinary injection molding and the like were prepared. Using these materials, several kinds of mixed powders having different soft magnetic ferrite powder contents were prepared. Each mixed powder was then fused, so that several kinds of mixed soft magnetic materials having different soft magnetic ferrite contents were prepared.

Figure 2:
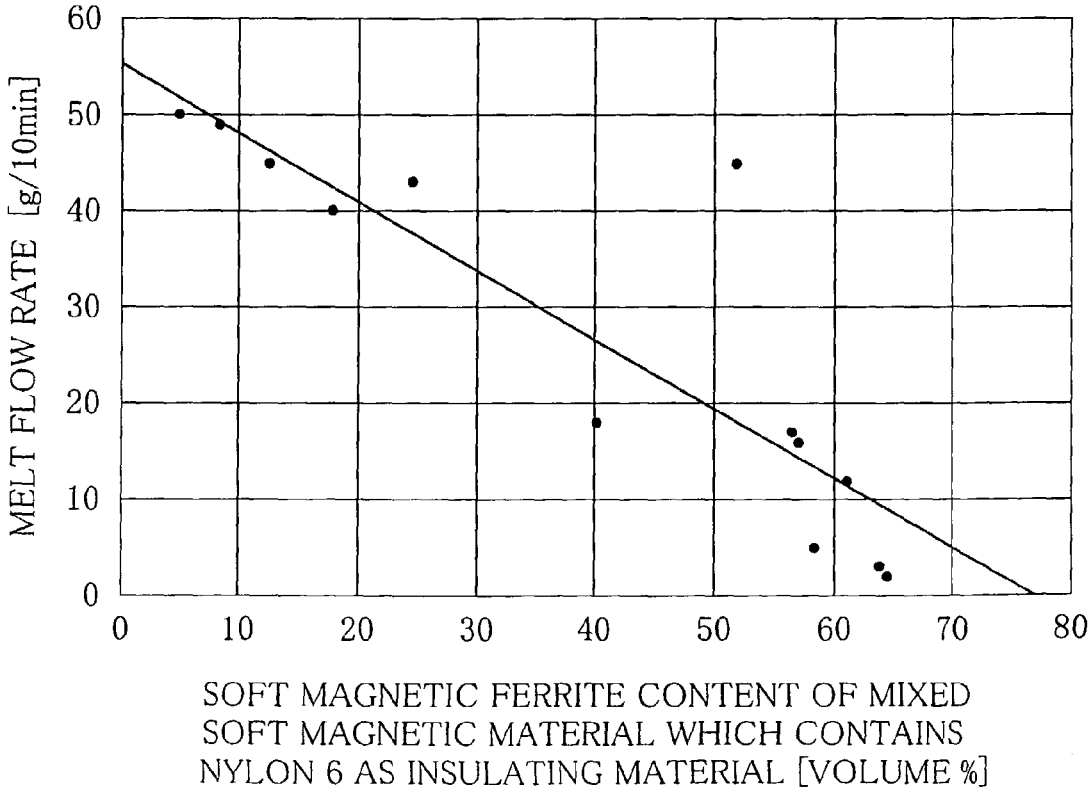
FIG. 2 is a graph showing the relation between the soft magnetic ferrite content of mixed soft magnetic material and the melt flow rate of the mixed soft magnetic material.

The melt flow rate of mixed soft magnetic materials containing nylon 6 as an insulating material was measured by a melt index test in accordance with JIS K 7210. Measurement was performed under the condition that measurement temperature was 270° C. and a load was 10.0 kg·f. When the soft magnetic ferrite content was 5 volume % or lower, the soft magnetic ferrite content had little influence on the melt flow rate. When the soft magnetic ferrite content was 70 volume % or higher, mixing to produce a mixed soft magnetic material was difficult. Therefore, the melt flow rate of mixed soft magnetic materials having the soft magnetic ferrite content of 5 to 65 volume % was measured by the melt index test. The results are shown in FIG. 2.

Next, using the above mixed soft magnetic materials, core members were formed as follows:

Using an injecting molding machine, each mixed soft magnetic material was formed into a core member of a predetermined shape, that is, a disc shape having a through-hole 2*a* at the center and a circular coil groove 2*b* in the disc face. Injection molding of mixed soft magnetic materials containing nylon 6 as an insulating material was performed under the ordinary condition of injection molding using nylon 6, and injection molding of mixed soft magnetic materials containing polypropylene as an insulating material was performed under the ordinary condition of injection molding using polypropylene.

Next, the relative permeability of formed core members was measured in accordance with JIS C2561. The results are shown as the relation between the soft magnetic ferrite content (volume %) and the relative permeability of a core member in FIG. 3, where black circles represent core members using nylon 6 as an insulating material and white circles represent core members using polypropylene as an insulating material.

Further, the volume resistivity of mixed soft magnetic materials was measured in accordance with JIS H 0505. The results are shown as the relation between the soft magnetic ferrite content (volume %) and the volume resistivity (Ω·cm) of mixed soft magnetic materials in FIG. 4, where black circles represent mixed soft magnetic materials using Mn—Zn ferrite as a soft magnetic ferrite and white circles represent mixed soft magnetic materials using Ni—Zn ferrite as a soft magnetic ferrite.

Figure 5:
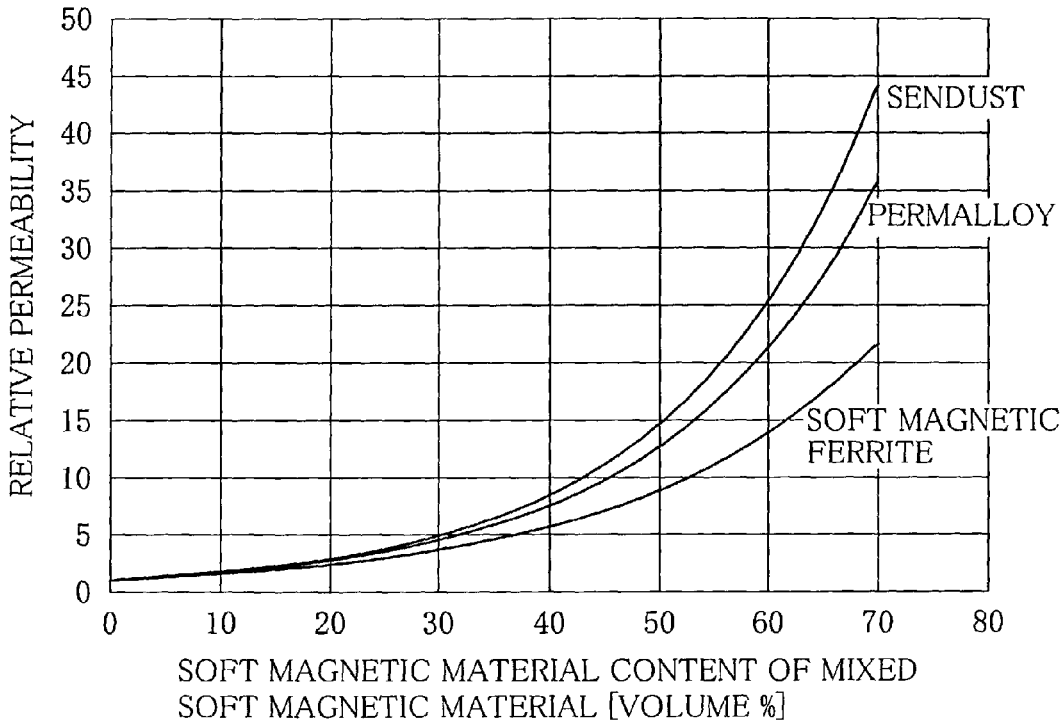
FIG. 5 shows relative permeability characteristic curves indicating the relation between the soft magnetic material (soft magnetic ferrite, Sendust, permalloy) content (volume %) and the relative permeability.

Further, FIG. 5 shows the relation between the soft magnetic ferrite content (volume %) and the relative permeability, the Sendust content (volume %) and the relative permeability and the permalloy content (volume %) and the relative permeability. This was obtained by calculation based on the measurement results of the soft magnetic ferrite content (volume %) and the relative permeability shown in FIG. 3, using general data on Sendust and permalloy. Soft magnetic ferrite, Sendust and permalloy were used as soft magnetic materials.

Figure 3:
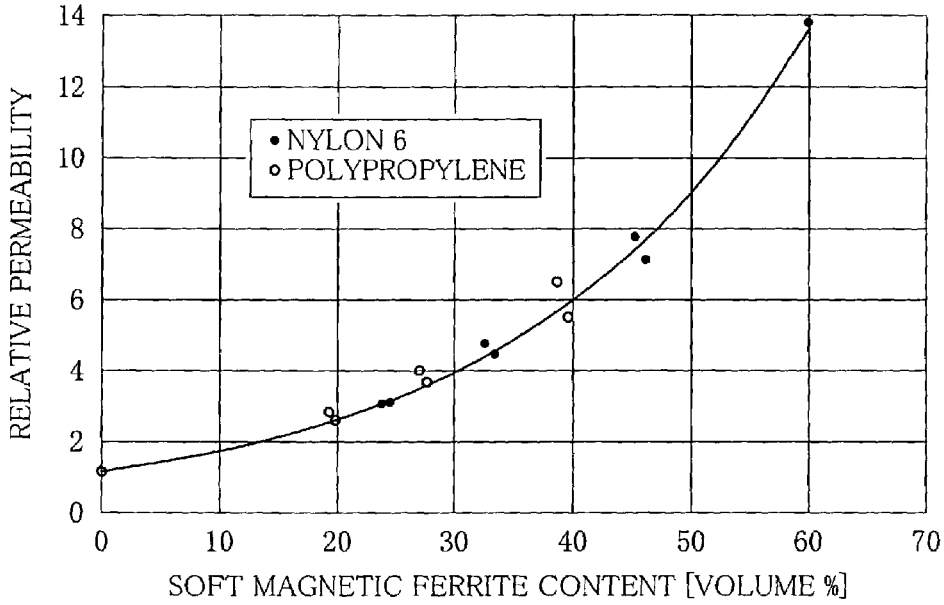
FIG. 3 is a graph showing the relation between the soft magnetic ferrite content of mixed soft magnetic material and the relative permeability of a core member formed thereof.

From FIGS. 2 and 3, the following has been found out. The higher the soft magnetic ferrite content (volume %) is, the higher the relative permeability of a core member is. The kind of insulating material contained in a mixed soft magnetic material has no influence on the permeability. The higher the soft magnetic ferrite content (volume %) is, the lower the flowability of a mixed soft magnetic material is.

When the soft magnetic ferrite content is higher than 70 volume %, mixing is difficult, and injection molding is difficult due to low flowability. Further, due to an increase of ferrite component having high hardness, a mold for injection molding wears quickly, the mechanical strength of a formed isolation transformer core is much lower, and a core is more difficult to form. Thus, the mixed soft magnetic material having the soft magnetic ferrite content higher than 70 volume % is unsuitable for a transformer core.

On the other hand, when the soft magnetic ferrite content is lower than 10 volume %, the relative permeability of a core member is low. Therefore, with an isolation transformer using isolation transformer cores comprising core members of this type, it is difficult to transmit power with a high efficiency.

When the soft magnetic ferrite content is in the range of 60 to 70 volume %, the relative permeability of a formed core member is high, but the flowability of a mixed soft magnetic material is relatively low. The mixed soft magnetic material having the soft magnetic ferrite content of this range is suitable for a core which is used in an isolation transformer requiring a relatively high transmission efficiency and does not have a very complicated shape.

When the soft magnetic ferrite content is in the range of 10 to 60 volume %, the relative permeability of a formed core member is relatively low, but the flowability of a mixed soft magnetic material is high. The mixed soft magnetic material having the soft magnetic ferrite content of this range is suitable for a core which is used in an isolation transformer not requiring a high transmission efficiency and has such a complicated shape that it can be formed only of material having a high flowability.

Figure 4:
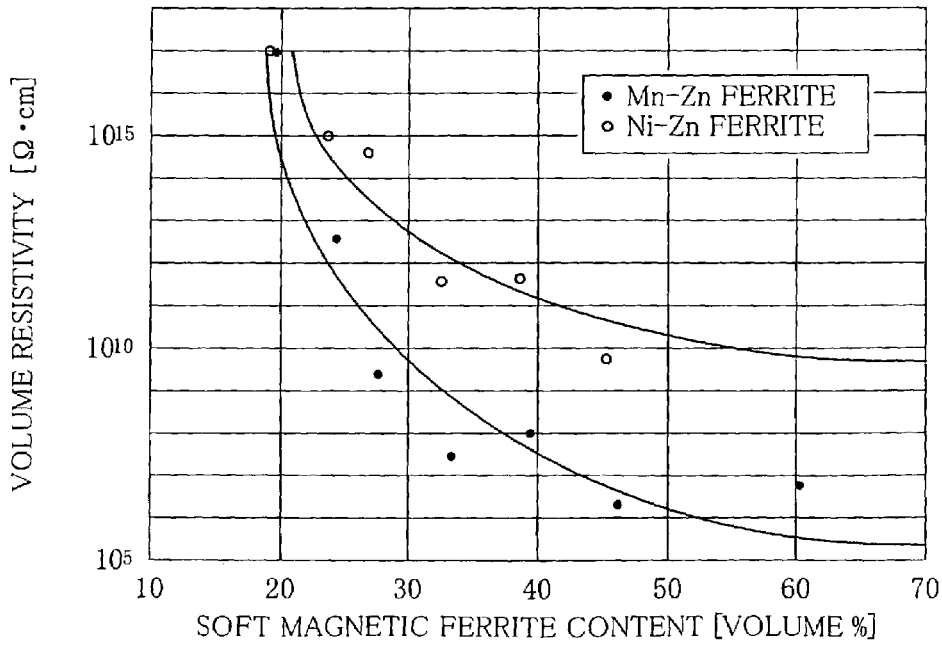
FIG. 4 shows volume resistivity characteristic curves indicating the relation between the soft magnetic ferrite content (volume %) of mixed soft magnetic material and the volume resistivity (Ω·cm) of the mixed soft magnetic material.

From FIG. 4, the following has been found out.

The higher the soft magnetic ferrite content (volume %) is, the lower the volume resistivity (Ω·cm) of a mixed soft magnetic material is. A mixed soft magnetic material containing Ni—Zn ferrite has a high volume resistivity, though it is expensive. It is desirable to use a mixed soft magnetic material containing Ni—Zn ferrite when a mixed soft magnetic material containing Mn—Zn ferrite does not satisfy a required volume resistivity.

When a mixed soft magnetic material has a low volume resistivity, grains composing the mixed soft magnetic material are not insulated well, so that eddy-current is easily induced by an ac magnetic field. Thus, the intended transmission efficiency of a transformer cannot be attained.

From FIG. 5, it has been found out that like soft magnetic ferrite, Sendust and permalloy also have properties required for use in an isolation transformer.

For an isolation transformer core used in a connector for a air bag as an automobile component, mixed soft magnetic material having the Mn—Zn soft magnetic ferrite content of 50±3 volume % is particularly favorable. This mixed soft magnetic material has a good flowability and a relatively high melt flow rate, and injection molding thereof is easy. The relative permeability of a core member formed thereof is about 10. Thus, an isolation transformer core formed of this mixed soft magnetic material is suitable for a connector for an air bag which has two cores arranged to face each other with a gap of 1 mm therebetween and permits rapid transmission of large amounts of power even if a gap varies in the range of ±0.5 mm.

In an isolation transformer core of the present invention, a core member is made of a mixed soft magnetic material comprising an insulating material having an electrical insulating property and a soft magnetic material. Thus, the isolation transformer core has an improved vibration resistance and a lowered fragility. Further, the relative permeability of a coil is relatively low. Therefore, the isolation transformer cores are suited to be arranged to face each other with a gap of about 1 mm therebetween and make rapid transmission of large amounts of power.

Further, when the soft magnetic material content is in the range of 10 to 70 volume %, the isolation transformer core of the present invention has the relative permeability required for rapid transmission of large amounts of power, and at the same time a mechanical strength higher than that of a core made of sintered ferrite alone.

The isolation transformer core of the present invention uses, as a soft magnetic material, soft magnetic ferrite or Sendust. The isolation transformer core using soft magnetic ferrite is suitable for a high-frequency transformer, because it has only a small eddy-current loss. The isolation transformer core using Sendust is advantageous in that it can be of a small size because it has a high saturation magnetic flux density (twice as high as that of ferrite).

The isolation transformer core of the present invention uses, as an insulating material, any of thermoplastic resin, thermoplastic rubber, silicone rubber, thermosetting resin and adhesive which all have flexibility and good formability. Therefore, the isolation transformer core has large shock resistance, and is easy to form even when it has a complicated shape. Thus, the vibration resistance of the isolation transformer core is much improved and manufacturing cost is lowered.

Next, with reference to FIGS. 6–9, an explanation will be given of a rotation sensor a core according to a second embodiment of the present invention.

Figure 6:
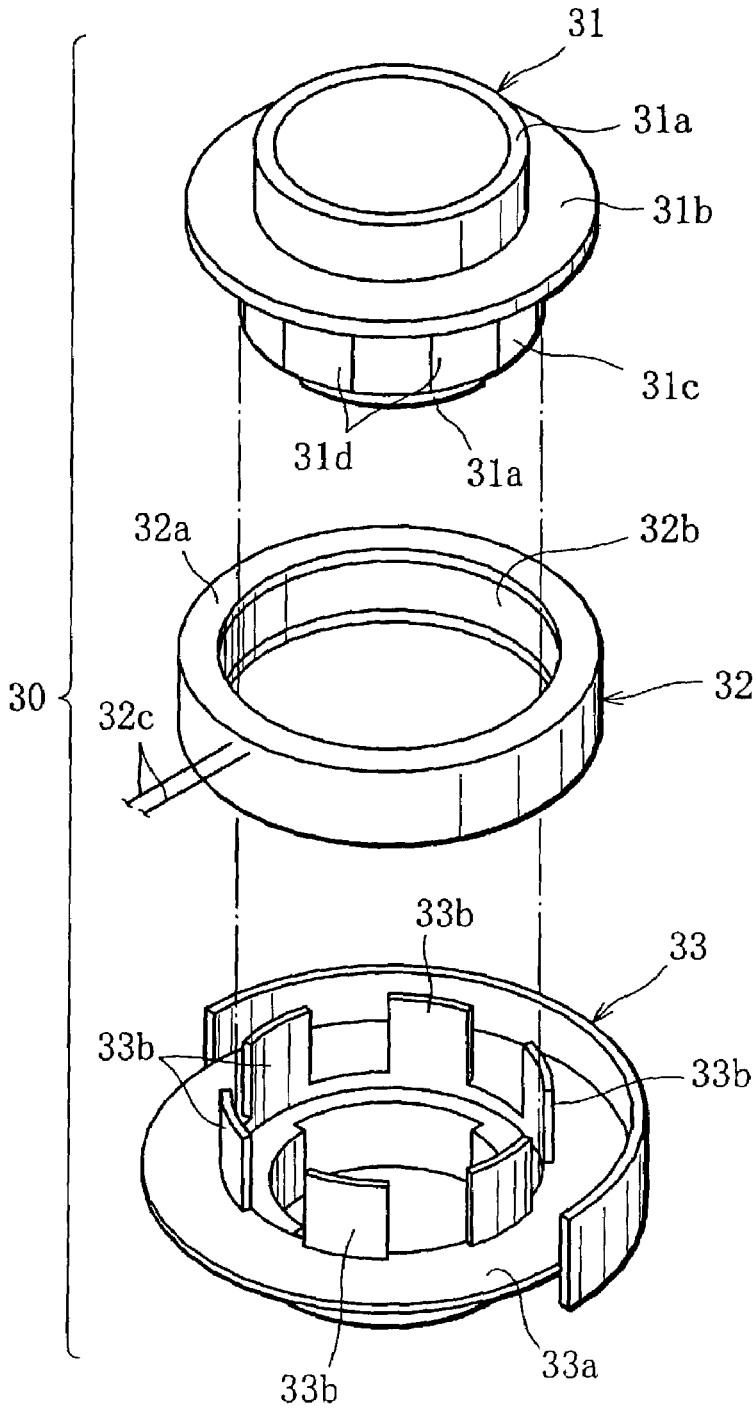
FIG. 6 is a perspective view of a rotation sensor according to a second embodiment of the present invention.
Figure 7:
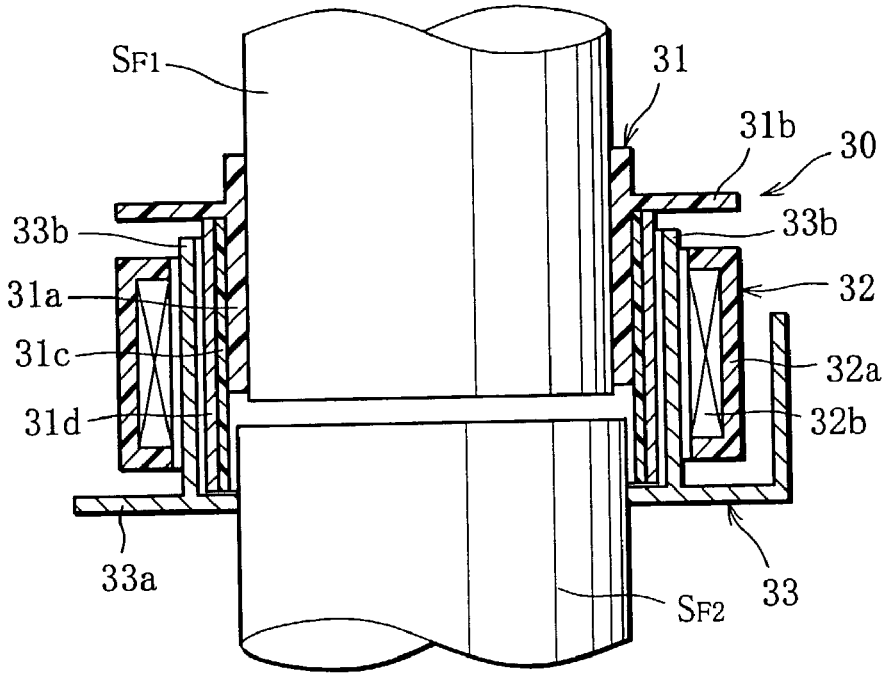
FIG. 7 is a sectional view showing the rotation sensor of FIG. 6 in a state where it is attached to first and second shafts.

As shown in FIG. 6, the rotation sensor 30 is provided with a first rotor 31, a stationary core 32, and a second rotor 33 and detects the angle of relative rotation of the relatively rotating first and second shafts SF1, SF2 (see FIG. 7). For example, the rotation sensor 30 is used to detect the rotation torque of an automotive steering wheel shaft caused by the transmission of the rotation torque from the drive shaft to the driven shaft through a torsion joint. The angle of relative rotation of the two shafts SF1 and SF2 varies within a range of ±8 degrees.

The first rotor 31 is formed into a cylindrical shape and attached to a predetermined position in the axial direction of the rotating first shaft SF1, as shown in FIG. 7. As shown in FIG. 6, the first rotor 31 is comprised of a cylindrical shaft 31*a* and a flange 31*b* made of a synthetic resin which is integrally formed with an upper portion of the cylindrical shaft and extends radially outward therefrom. An insulating magnetic member 31*c* is attached to the outer circumference of the cylindrical shaft 31*a*. A plurality of conductors, that is, copper foils 31*d*, are adhered to a surface of the insulating magnetic member 31*c* at predetermined intervals, for example, intervals of a central angle of 60 degrees in the circumferential direction.

The copper foils 31*d* may be provided inside rather than at the surface of the insulating magnetic member 31*c*. The conductor layers may be made of an electrically conductive material such as aluminum, silver, or iron other than the copper foils 31*d*. Theoretically, the smaller the central angle and the smaller the arrangement intervals, the larger the number of conductor layers, the larger the amount of change of the eddy current (proportional to the number of conductive layers) induced in the members of the rotation sensor, and the higher the detection sensitivity of the angle of relative rotation, but the smaller the range of angles that can be measured. The rotation sensor 30 is provided with copper foils 31*d* at intervals of central angles of 60 degrees as explained above, so the maximum range of angle measurable is about 30 degrees.

In magnetoelectric engineering, the following inequality is widely used as a measure of the thickness t (mm) required for the conductor layer:

$$t \geqq 1/(\omega\kappa\mu)^{1/2}$$

where ω is the angular frequency of the signal, κ is the electroconductivity of the conductor layer, and μ is the magnetic permeability of vacuum.

According to the inequality, when the conductor layers is fabricated by copper foils 31*d*, the thickness required for shielding against a magnetic field of 100 kHz is at least about 0.158 mm. When the copper foils 31*d* is 0.2 mm in thickness t and an AC magnetic field is 100 kHz in frequency, the magnetic resistance generated by the copper foils 31*d* becomes sufficiently larger than the magnetic resistance caused by the radial gap G between the first rotor 31 and the stationary core 32. Due to the shielding effect of the copper foils 31*d*, the rotation sensor 30 can form an AC magnetic field having a large irregularity in distribution, even if the sensor is small in size.

Figure 9:
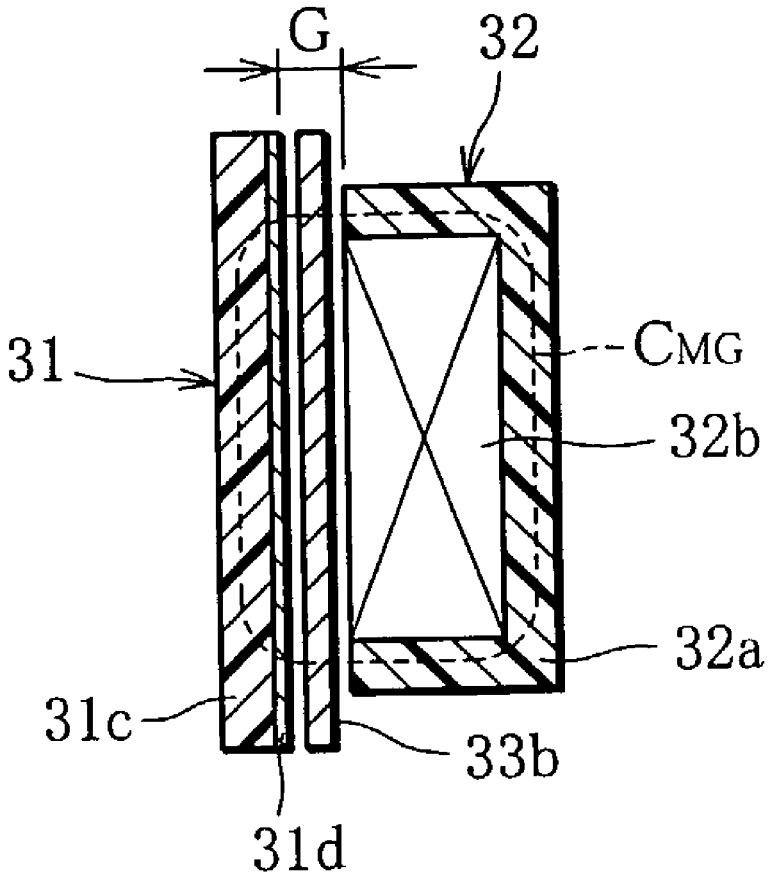
FIG. 9 is a sectional view of the schematic configuration of the rotation sensor of FIG. 7 enlarging the right half.

As shown in FIG. 9, the stationary core 32 is fixed to a fixing member (not shown) positioned near the steering wheel shaft at a radial gap G from the first rotor 31 and has a core body 32*a* comprised of an insulating magnetic material and an excitation coil 32*b* cooperating with the first rotor 31 to form a magnetic circuit CMG whose magnetic flux is concentrated as shown in FIG. 9. Therefore, as shown in FIG. 9, if the first rotor 31 is larger the second rotor 33 in height in the axial direction, fluctuation of the output of the sensor can be suppressed, even if the first and second rotors 31, 33 are axially offset from each other. The excitation coil 32*b* is connected with a signal processing circuit, not shown, by a cable 32*c* extending outside (see FIG. 6), and an AC current flows from the signal processing circuit.

As shown in FIG. 6, the second rotor 33 includes a ring-shaped body 33*a* and a plurality of metal teeth 33*b* equally arranged in a ring at the ring-shaped body 33*a*. The metal teeth 33*b* are spaced from the copper foils 31*d*. For example, the second rotor 33 is comprised of copper, a copper alloy, aluminum, an aluminum alloy, iron, or an iron alloy. As shown in FIG. 6, the metal teeth 33*b* are arranged equally in a ring in the same way as the copper foils 31*d* and are provided corresponding to the copper foils 31*d*. Alternatively, the second rotor 33 can be configured as follows: Conductor layers of a certain thickness (for example, 0.2 mm copper foil or aluminum, silver, iron, or other materials), corresponding in number to the copper foils 31*d*, are arranged evenly in a ring inside a tubular member of the insulating material or on a cylindrical surface of the tubular member so as to correspond to the copper foils 31*d*. The second rotor 33 adjoins the first rotor 31 and is attached to the second shaft SF2 which rotates relative to the first shaft SF1 (see FIG. 7). As shown in FIG. 7, the metal teeth 33*b* are arranged between the first rotor 31 and stationary core 32.

The rotation sensor 30 is assembled so that the first and second rotors 31, 33 are individually attached to the first and second shafts SF1, SF2, with the stationary core 32 fixed to the fixing member.

In the assembled rotation sensor 30, the magnetic flux is formed along the magnetic circuit CMG shown in FIG. 9 when the AC current flows through the excitation coil 32*b*. Since the AC magnetic field crosses the copper foils 31*d* of the first rotor 31, an eddy current is induced on the surface of the copper foils 31*d*. At this time, the direction of the AC magnetic field induced by the eddy current is opposite to the direction of the AC magnetic field caused by the AC current flowing through the excitation coil 32*b*. As a result, the directions of the magnetic fluxes caused by the AC excitation current and the eddy current become opposite in a gap space where conductor layers are present, and hence the total magnetic flux becomes small. Conversely, both the directions are the same from each other in a gap space where no conductor layers are present, so the total magnetic flux density becomes larger.

Figure 8:
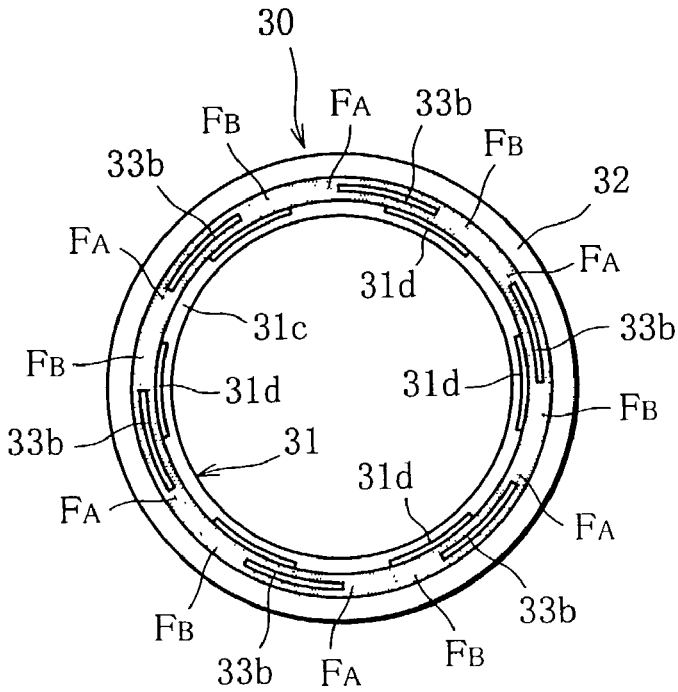
FIG. 8 is a plan view of an assembled rotation sensor.

Therefore, as shown in FIG. 8, in the gap G formed between the first rotor 31 and the stationary core 32 of the rotation sensor 30, regions FB where a copper foils 31*d* is present and the magnetic flux density is small and regions FA where no copper foils 31*d* is present and the magnetic flux density is large are alternately formed in the circumferential direction. As a result, an irregular magnetic field is produced with intervals of a central angle of 60 degrees in the circumferential direction in the gap G between the first rotor and the stationary core 32 of the rotation sensor 30. In FIG. 8, the illustration of the cylindrical shaft 31*a* of the first rotor 31 is omitted.

When the first rotor 31 rotates together with the first shaft SF1 relative to the second rotor 33, the irregular magnetic field also rotates in the circumferential direction along with the first rotor 31. In the gap G, metal teeth 33*b* formed in the circumferential direction at intervals of central angles of 60 degrees cross the irregular magnetic field. At that time, due to the relative rotation of the first and second rotors 31 and 33, there occurs a change in a ratio of the area of the metal teeth 33*b* positioned in the zone FB having a small magnetic flux density to the area thereof positioned in the zone FA having a large magnetic flux density. This causes a change in the amount of the total magnetic flux crossing the metal teeth 33*b*, so that the magnitude of the eddy current occurring in the metal teeth 33*b* changes.

Therefore, with the relative rotation of the first and second rotors 31, 33 of the rotation sensor 30, the magnitude of the eddy current occurring at the metal teeth 33*b* changes and the impedance of the excitation coil 32*b* fluctuates with the change in the angle of relative rotation. Therefore, the rotation sensor 30 can simply detect the angle of relative rotation between the first and second rotors 31, 33 by measuring the impedance by a known method with use of the signal processing circuit connected to the excitation coil 32*b*.

The rotation sensor 30 is so constructed that the first rotor 31 rotates at a gap G with respect to the stationary core 32, and hence the size of the gap between the members has a direct effect on the manufacturing cost, whereas it is extremely difficult to set the gap G to several μm in the rotation sensor 30. To obtain such a gap, precision is required in manufacturing the component parts and in assembling the component parts. In particular, when the rotation sensor 30 is used for detection of a rotational torque in an automotive steering wheel shaft, it is ideal to make the gap G on the millimeter order, considering the vibration etc. caused during the automotive driving.

In this connection, the effective magnetic permeability of the magnetic circuit CMG is determined by the specific magnetic permeability of the insulating magnetic member 31*c* or core body 32*a* and the size of the gap G. In particular, when the ratio of the length of the magnetic circuit CMG and the size of the gap G is of an order the same as the specific magnetic permeability of the magnetic material, the effective magnetic permeability of the magnetic circuit CMG is almost entirely governed by the size of the gap G, so the effect of the specific magnetic permeability of the magnetic material becomes extremely small. For example, when the ratio between the length of the magnetic circuit CMG and the gap G is much smaller than the specific magnetic permeability of the soft magnetic material as in the case of a gap G of several millimeters for a length of the magnetic circuit CMG of 100 mm, the effective magnetic permeability is determined almost entirely by the size of the gap G.

That is, in the rotation sensor 30, the effective magnetic permeability of the magnetic circuit CMG ends up determined substantially by the size of the gap G no matter how large the specific magnetic permeability of the insulating magnetic member 31*c* or the core body 32*a*.

Therefore, the insulating magnetic member 31*c* or core body 32*a* is formed of nylon, polypropylene (PP), polyphenylene sulfide (PPS), ABS resin, or another thermoplastic synthetic resin having an electrical insulation property into which is mixed 10 to 50±3 vol %, preferably 30 to 50±3 vol %, more preferably 50±3 vol % soft magnetic material powder comprised of an Ni—Zn or Mn—Zn based ferrite.

Although an effective magnetic permeability of the magnetic circuit CMG is somewhat smaller than a conventional soft magnetic material using ferrite, the rotation sensor 30 is advantageous in that it has high flowability of the core members 31*c*, 32*a* during injection-molding, is improved in vibration resistance, easy to manufacture with reduced costs, and is suitable for mass production.

Since an eddy current affecting the impedance of the excitation coil 32*b* does not flow in the core material which is an insulating material but flows only in the conductor layers, that is, the copper foils 31*d*, so the rotation sensor 30 is given more linear characteristics of the detection sensitivity and detection output.

In the second embodiment, Sendust may be used as a soft magnetic material, and thermoplastic rubber or thermosetting resin may be used as an insulating material.

What is claimed is:

1. An isolation transformer comprising:

isolation transformer cores facing each other with a gap therebetween to form a magnetic circuit having an effective relative permeability almost exclusively depending on the gap, each of said cores including;

a coil, and a core member accommodating the coil, the core member being as formed by injection molding, containing 10 to 50 volume % of a soft magnetic material powder and a remainder being an electrically insulating material, and having a relative permeability of 1.6 to 15.

2. The transformer according to claim 1, wherein the gap is in a range of mm order.

3. The transformer according to claim 2, wherein the gap is in a range of 1.0 mm±0.5 mm.

4. The transformer core according to claim 3, wherein the soft magnetic material is soft magnetic ferrite or Sendust.

5. The transformer core according to claim 4, wherein the insulating material is any one of thermoplastic resin, thermoplastic rubber and thermosetting resin.

6. The transformer core according to claim 5, wherein the insulating material is any one of thermoplastic resin, thermoplastic rubber and thermosetting resin.

7. An automotive component, comprising:

core members facing each other with a gap therebetween to form a magnetic circuit having an effective relative permeability almost exclusively depending on the gap, each of the core members being as formed by injection molding, containing 10 to 50 volume % of a soft magnetic material powder and a remainder being an electrically insulating material, and having a relative permeability of 1.6 to 15.

8. The automotive component according to claim 7, wherein the gap is in a range of mm order.

9. The automotive component according to claim 8, wherein the gap is in a range of 1.0 mm±0.5 mm.

10. The automotive component according to claim 9, wherein the soft magnetic material is soft magnetic ferrite or Sendust.

11. The automotive component according to claim 10, wherein the insulating material is any one of thermoplastic resin, thermoplastic rubber and thermosetting resin.

12. The automotive component according to claim 9, wherein the insulating material is any one of thermoplastic resin, thermoplastic rubber and thermosetting resin.

13. A rotation sensor tar detecting a relative rotation angle between first and second shafts, comprising:

a first rotor mounted to the first shaft and including a first core member;

a stator fixed to a fixing member and including a stationary core, the stationary core facing the first core member with a gap therebetween to torm a magnetic circuit having an effective relative permeability almost exclusively depending on the gap together with the stationary core and including an excitation coil and a stationary core member accommodating the excitation coil;

a second rotor mounted to the second shaft; and shield members provided to the first and second rotors, respectively, for changing the effective relative permeability when the relative rotation angle changes, wherein each of the first and stationary core members is as formed by injection molding and contains 10 to 50 volume % of a soft magnetic material powder and a remainder being an electrically insulating material, the first and stationary core members each having relative permeability of 1.6 to 15.

14. The rotation sensor according to claim 13, wherein the gap is in a range of mm order.

15. An automotive component, comprising:

cores facing each other with a gap therebetween and forming a magnetic circuit having an effective relative permeability almost exclusively depending on the gap, each of said cores including;

a coil, and a core member accommodating the coil, the core member being as formed by injection molding, containing 10 to 50 volume % of a soft magnetic material powder and a remainder being an electrically insulating material, and having a relative permeability of 1.6 to 15.

16. The automotive component according to claim 15, wherein the gap is in a range of mm order.

17. The automotive component according to claim 16, wherein the gap is in a range of 1.0 mm±0.5 mm.

18. The automotive component according to claim 17, wherein the soft magnetic material is soft magnetic ferrite or Sendust.

19. The automotive component according to claim 18, wherein the insulating material is any one of thermoplastic resin, thermoplastic rubber and thermosetting resin.

20. The automotive component according to claim 17, wherein the insulating material is any one of thermoplastic resin, thermoplastic rubber and thermosetting resin.

* * * * *